US011772150B2

(12) United States Patent
Takahashi et al.

(10) Patent No.: US 11,772,150 B2
(45) Date of Patent: Oct. 3, 2023

(54) METHOD FOR MANUFACTURING CAST PRODUCT USING BREATHABLE SALT CORE

(71) Applicant: HONDA FOUNDRY CO., LTD., Kawagoe (JP)

(72) Inventors: Masao Takahashi, Kawagoe (JP); Hisaki Watanabe, Kawagoe (JP); Kenta Abe, Kawagoe (JP); Yohei Sekiguchi, Kawagoe (JP)

(73) Assignee: Honda Foundry Co., Ltd., Saitama (JP)

( * ) Notice: Subject to any disclaimer, the term of this patent is extended or adjusted under 35 U.S.C. 154(b) by 0 days.

(21) Appl. No.: 17/761,336

(22) PCT Filed: Dec. 20, 2019

(86) PCT No.: PCT/JP2019/050033

§ 371 (c)(1),
(2) Date: Mar. 17, 2022

(87) PCT Pub. No.: WO2021/124542

PCT Pub. Date: Jun. 24, 2021

(65) Prior Publication Data

US 2022/0362837 A1 Nov. 17, 2022

(51) Int. Cl.

| | |
|---|---|
| ***B22C 9/10*** | (2006.01) |
| ***B22C 9/24*** | (2006.01) |
| ***B22D 25/02*** | (2006.01) |

(52) U.S. Cl.
CPC ..... *B22C 9/105* (2013.01)

(58) Field of Classification Search
CPC .. B22C 1/00; B22C 9/10; B22C 9/105; B22C 9/24; B22D 25/02
USPC ..... 164/6, 137, 138, 369
See application file for complete search history.

(56) References Cited

U.S. PATENT DOCUMENTS 6,035,923 A * 3/2000 Oda et al. ..... B22D 19/14 164/410
2001/0030035 A1* 10/2001 Oda ..... B22D 19/14 164/100

FOREIGN PATENT DOCUMENTS

| | | | |
|---|---|---|---|
| JP | S60-3958 | A | 1/1985 |
| JP | 2570422 | Y2 | 5/1998 |
| JP | 2005-131664 | A | 5/2005 |
| JP | 2015-024412 | A | 2/2015 |

* cited by examiner

*Primary Examiner* — Kevin P Kerns
(74) *Attorney, Agent, or Firm* — Carrier, Shende & Associates P.C.; Joseph P. Carrier; Fulchand P. Shende

(57) ABSTRACT

A breathable salt core is provided that is placed in a cavity of a casting mold in order to mold a hollow part of a cast product and that is dissolved and removed after casting, the breathable salt core being formed by powder molding innumerable salt particles into a predetermined shape corresponding to the hollow part, wherein a gap that can retain a gas remaining in the cavity in a casting process is formed between the innumerable salt particles that have been powder molded. The breathable salt core thus manufactured assures that residual gas within the cavity pushed by the molten metal to enter the gap formed between salt particles of the salt core, thereby avoiding any incomplete filling of the molten metal, and which can be formed with a simple production process at a low cost.

8 Claims, 8 Drawing Sheets

(A)

(B)

◆SEM PHOTOGRAPH OF SALT CORE SURFACE

| EMBODIMENT | CONVENTIONAL EXAMPLE |
| --- | --- |
|  |  DISINTEGRATED SALT PARTICLES ARE CRUSHED TO CAUSE CLOGGING ⇒CAUSE FOR DEGRADATION OF RUNNING OF MOLTEN METAL |

17

18

METHOD FOR MANUFACTURING CAST PRODUCT USING BREATHABLE SALT CORE

TECHNICAL FIELD

The present invention relates to an improvement of a method for manufacturing a cast product using a breathable salt core that is used when producing a cast component having a hollow part in an interior thereof.

BACKGROUND ART

A sand core or a salt core is known as a core that is used when producing a cast component having a hollow part in its interior. These cores are set at a position corresponding to the hollow part of the cast component in the cavity of a casting mold. After the cavity is charged with a molten metal, in the case of the sand core it is made to collapse and the starting sand is discharged outside, and in the case of the salt core the starting salt is dissolved and removed by applying high pressure water. Among them, the salt core is often used when producing a cast component having a hollow part in its interior in an environment in which attachment of sand should be avoided, such as for a piston of an internal combustion engine in particular, and as such a method for manufacturing a cast product using a salt core. One disclosed in Patent Document 1 below is already known.

PRIOR ART DOCUMENTS

Patent Documents

Patent Document 1: Japanese Patent Application Laid-open No. 2015-24412

SUMMARY OF THE INVENTION

Problems to be Solved by the Invention

With regard to a conventional salt core as disclosed in Patent Document 1 above, before setting the powder-molded salt core in the cavity of a casting mold, it is subjected to machining processing for molding it into a predetermined shape. In order to ensure a strength that can withstand such machining processing, powder molding is usually carried out by a high pressure press to increase the charging density, and calcination is carried out in order to further increase the strength. Because of this, the conventional salt core cannot retain, between salt particles of the salt core, gas remaining in the cavity. When pouring a molten metal, at a position where molten metal that has gone around into an upper part from an inner peripheral side of the salt core combines with molten metal that has gone around into the upper part from an outer peripheral side of the salt core, residual gases in the cavity pushed out by the molten metal that has gone around from the inner peripheral side and the outer peripheral side collide in a part where they meet, thus impairing the flowability of the molten metal and thereby facilitating incomplete filling.

In order to provide countermeasures therefor, in the arrangement of Patent Document 1 above, the salt core is provided with a groove in a center part of its upper face so as to make residual gas in the cavity that is pushed out by molten metal escape via the groove. However, by so doing the production process for the salt core becomes complicated, thus causing an increase in the cost.

It is therefore an object of the present invention to provide a breathable salt core that causes hardly any incomplete filling of a molten metal due to gaps capable of retaining gas remaining in the cavity being formed between salt particles of the salt core and due to gas remaining in the cavity in a casting process being retained in the gap, that enables residual gas to enter the gap, thus preventing the flow of molten metal from being impaired even without providing the salt core with a groove for residual gas within the cavity pushed by the molten metal to escape, and that can be formed with a simple production process at a low cost, and also to provide a method for manufacturing the salt core.

Means for Solving the Problems

In order to attain the above object, according to a first aspect of the present invention, there is provided a method for manufacturing a cast product using a breathable salt core that is placed in a cavity of a casting mold in order to mold a hollow part of the cast product and that is dissolved and removed after casting, wherein the breathable salt core, which is formed by powder molding innumerable salt particles into a predetermined shape corresponding to the hollow part and in which a gap that can retain residual gas within the cavity pushed out by molten metal in a casting process is formed between the innumerable salt particles, is placed within the cavity of the casting mold in an uncalcined state, and in the subsequent casting process, the residual gas within the cavity, which is pushed out by molten metal, is made to enter the gap via a surface of the breathable salt core and be retained within the breathable salt core.

Further, according to a second aspect of the present invention, there is provided a method for manufacturing a cast product using a breathable salt core that is placed in a cavity of a casting mold in order to mold a hollow part of the cast product and that is dissolved and removed after casting, wherein the breathable salt core, which has a charging density subsequent to powder molding of 88% to 92% and is formed by powder molding innumerable salt particles into a predetermined shape corresponding to the hollow part and in which a gap that can retain residual gas within the cavity pushed out by molten metal in a casting process is formed between the innumerable salt particles, is placed within the cavity of the casting mold in an uncalcined state, and in the subsequent casting process, the residual gas within the cavity, which is pushed out by molten metal, is made to enter the gap via a surface of the breathable salt core and be retained within the breathable salt core.

Furthermore, according to a third aspect of the present invention, in addition to the first or second aspect, the cast product is a piston for an internal combustion engine, and the hollow part is a cooling channel in a crown of the piston.

Moreover, according to a fourth aspect of the present invention, in addition to any one of the first to third aspects, the breathable salt core is used in an uncalcined state.

Further, according to a fifth aspect of the present invention, there is provided a method for manufacturing the breathable salt core according to the first aspect, wherein the salt particles are powder molded at a molding pressure of 80 to 130 MPa so as to give a charging density of 88% to 92%, and a calcination step and a machining processing step subsequent to the powder molding are omitted.

Furthermore, according to a sixth aspect of the present invention, in addition to the fifth aspect, the salt particles, which do not contain an additive, are directly powder molded on their own.

Effects of the Invention

In accordance with the first aspect of the present invention, since the breathable salt core, which is placed in the cavity of the casting mold and is dissolved and removed after casting, is formed by powder molding the innumerable salt particles into a predetermined shape corresponding to the hollow part of the cast product, and the gap, which is capable of retaining gas remaining in the cavity in the casting process, is formed between the innumerable powder molded salt particles, without providing the salt core with a groove via which residual gas within the cavity that is pushed out by molten metal can escape, it is possible by making gas remaining in the cavity in the casting process enter the gap and be retained thereby, to prevent the flow of molten metal from being inhibited by residual gas, thus forming a salt core having good running properties so that hardly any incomplete filling of the molten metal occurs.

Moreover, since it is not necessary to specially provide the breathable salt core with a groove via which residual gas within the cavity pushed out by the molten metal can escape, the production process is simple, and it can be formed at low cost.

Furthermore, in accordance with the second aspect of the present invention, since the breathable salt core has a charging density of 88% to 92%, it is possible to fully ensure the gap, which retains gas remaining in the cavity in the casting process, to thus achieve good running properties and it is also possible to maintain a strength that can prevent setting cracks from occurring when it is set within the cavity.

Moreover, in accordance with the third aspect of the present invention, since the cast product is a piston for an internal combustion engine, and the hollow part is a cooling channel in the crown of the piston, the piston equipped with the cooling channel having good running properties can easily be produced at low cost.

Furthermore, in accordance with the fourth aspect of the present invention, since the breathable salt core is used without being calcined, it is possible to prevent the salt particles from being melted accompanying calcination, thus enabling the gap, which is capable of retaining gas remaining in the cavity, to be reliably formed between the salt particles.

Moreover, in accordance with the fifth aspect of the present invention, the breathable salt core is powder molded from the salt particles with a molding pressure of 80 to 130 MPa so as to give a charging density of 88% to 92%, and after powder molding it is produced without carrying out a calcination step or a machining processing step. Due to the powder molding being carried out with a low pressure of 80 to 130 MPa, the mold of the molding machine for the salt core does not require high strength, and the cross-sectional shape of the salt core can therefore be molded by the mold as it is, thus enabling a machining processing step to be omitted. Moreover, due to the charging density being set at 88% to 92% at that time, it is possible to prevent setting cracks from occurring even when the salt core is set within the cavity as it is, thus enabling a calcination step to be omitted, and the production process is thereby simple and the cost is low. Furthermore, due to the powder molding being carried out with a low pressure, the gap, which is capable of retaining gas remaining in the cavity in the casting process, is formed between the innumerable salt particles subsequent to molding, and it is therefore possible by making gas remaining in the cavity in the casting process enter the gap to prevent the flow of molten metal from being impaired, thus enabling the breathable salt core having good running properties to be formed.

Furthermore, in accordance with the fifth aspect of the present invention, since in the breathable salt core the salt particles having a substantially uniform particle size and containing no additive are directly powder molded with a low pressure on their own, it is possible to use for producing the cast product a breathable salt core that forms simply and inexpensively a gap that is capable of retaining gas between the salt particles by eliminating an operation of blending salt particles having different particle sizes or adding an additive such as a binder such as water glass or a lubricant such as a metallic soap.

EXPLANATION OF REFERENCE NUMERALS AND SYMBOLS

1 Casting mold
2 Cavity
4 Salt core
10 Gas
17 Salt particles
18 Gap
C Cooling channel
P Piston for internal combustion engine

MODES FOR CARRYING OUT THE INVENTION

An embodiment in which a method for manufacturing of a cast product using the breathable salt core of the present invention is applied to molding of a cooling channel in the crown of a piston for an internal combustion engine is explained below by reference to the attached drawings.

First Embodiment

In the explanation below, for convenience a portion on the upper side of the paper of FIG. 2 (A) is referred to as being up and a portion on the lower side of the paper is referred to as being down.

Figure 1:
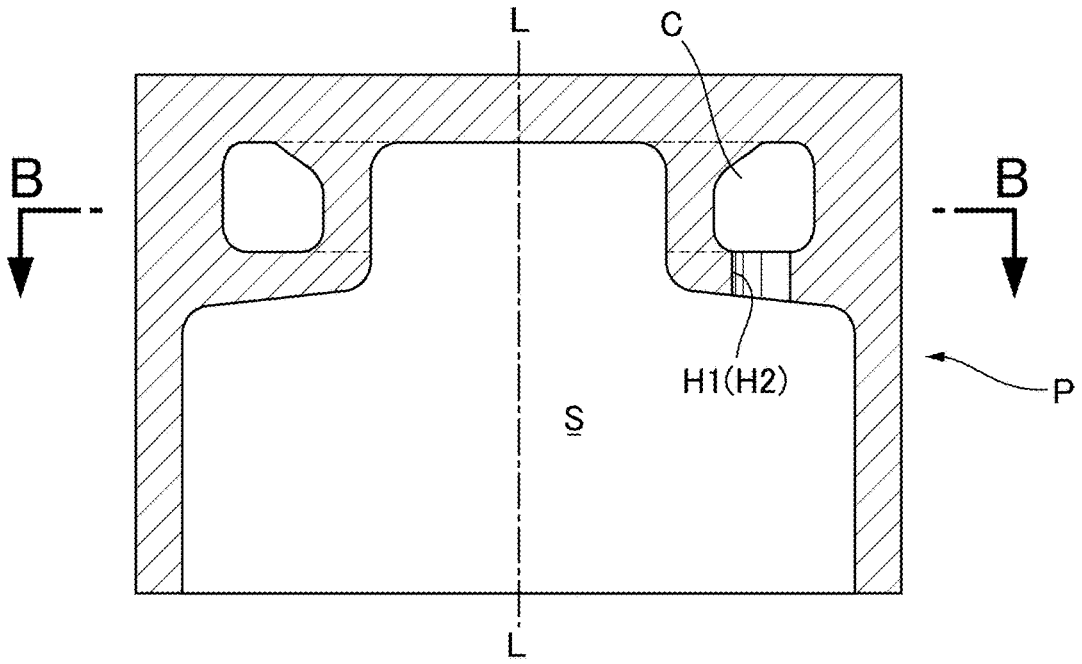
FIG. 1 (A) is a sectional view (sectional view along A-A in FIG. 1 (B)) of a piston for an internal combustion engine having a cooling channel that has been molded using a manufacturing method of the present invention, and FIG. 1 (B) is a sectional view along B-B in FIG. 1 (A). (first embodiment)
Figure 1:
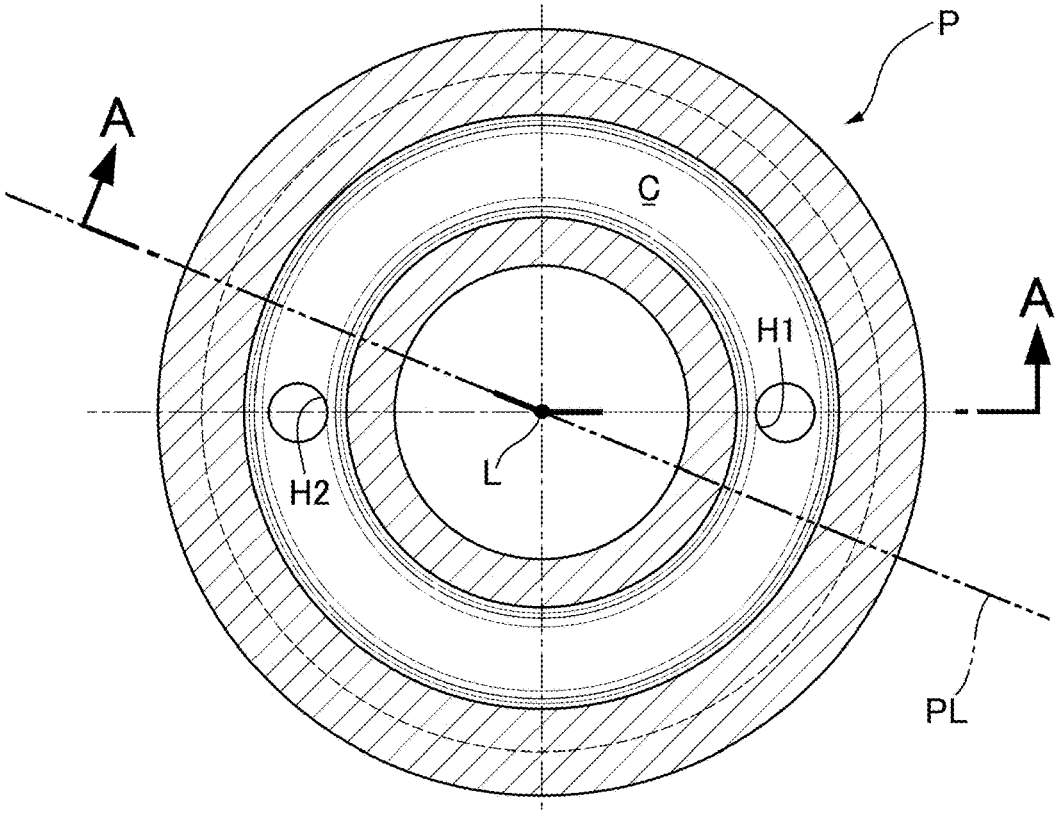

A piston P for an internal combustion engine shown in FIG. 1 has a cooling channel C in its crown, and the crown of the piston P is cooled by introducing an oil jet that has been injected from an interior space S side of the piston P beneath the cooling channel C via one of two openings H1, H2 formed in a lower face of the cooling channel C and discharging it via the other opening. In FIG. 1 (A), a portion on the right-hand side with respect to a central axis L of the piston P is a sectional view passing through the opening H1 as shown in the right half in a cross section along A-A in FIG. 1 (B), and a portion on the left-hand side is a sectional view containing a parting line PL, which is described later, as shown in the left half in the cross section along A-A in FIG. 1 (B).

Figure 2:
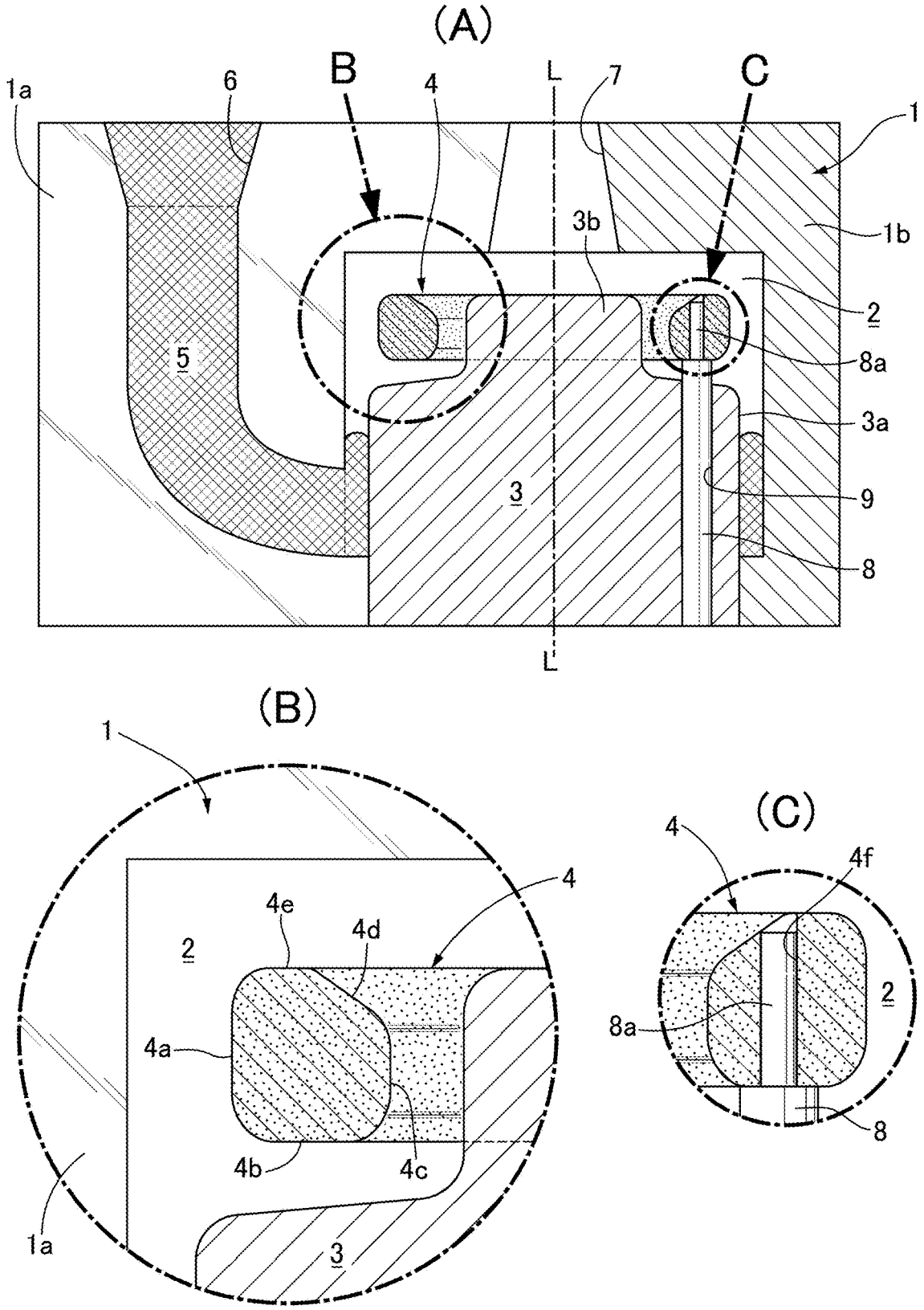
FIG. 2 (A) is a sectional view showing a state in which the breathable salt core is set in a cavity of a mold of a production device for producing the piston P for an internal combustion engine of FIG. 1, and FIGS. 2 (B), (C) are enlarged perspective views showing parts B, C of the above. (first embodiment)

FIG. 2 (A) shows a casting device for casting the piston P having the cooling channel C, the casting device including a mold 1 having left and right molds 1*a*, 1*b* that can be split with the parting line PL shown in FIG. 1 (B) as mating faces, a cavity 2 that is formed in the interior of the mold 1, a metal core 3 that is disposed within the cavity 2 and is for molding the interior space S of the piston P, and a breathable salt core 4 that is disposed on an outer peripheral side on the upper side of the metal core 3 and is for molding the cooling channel C.

Formed in the mold 1 is a pouring inlet 6 via which a molten metal 5 is poured into the cavity 2 from a ladle, which is not illustrated. Formed at positions above the cavity 2 are a feeder part for the molten metal 5 thus poured and a degassing hole 7 via which gas within the molten metal 5 is discharged.

The metal core 3 is for molding the interior space S of the piston P, is formed so as to have a substantially convex shaped cross section, is vertically movably mounted on a bottom face of the cavity 2, and is formed from a large-diameter cylindrical portion 3*a* on the lower side and a small-diameter cylindrical portion 3*b* extending upward from the upper end of the large-diameter cylindrical portion 3*a*. Formed at symmetrical positions with respect to the central axis L on a radially outer peripheral side of the large-diameter cylindrical portion 3*a* are vertically extending through holes 9 through which a pair of support rods 8 supporting the salt core 4 are inserted.

Figure 3:
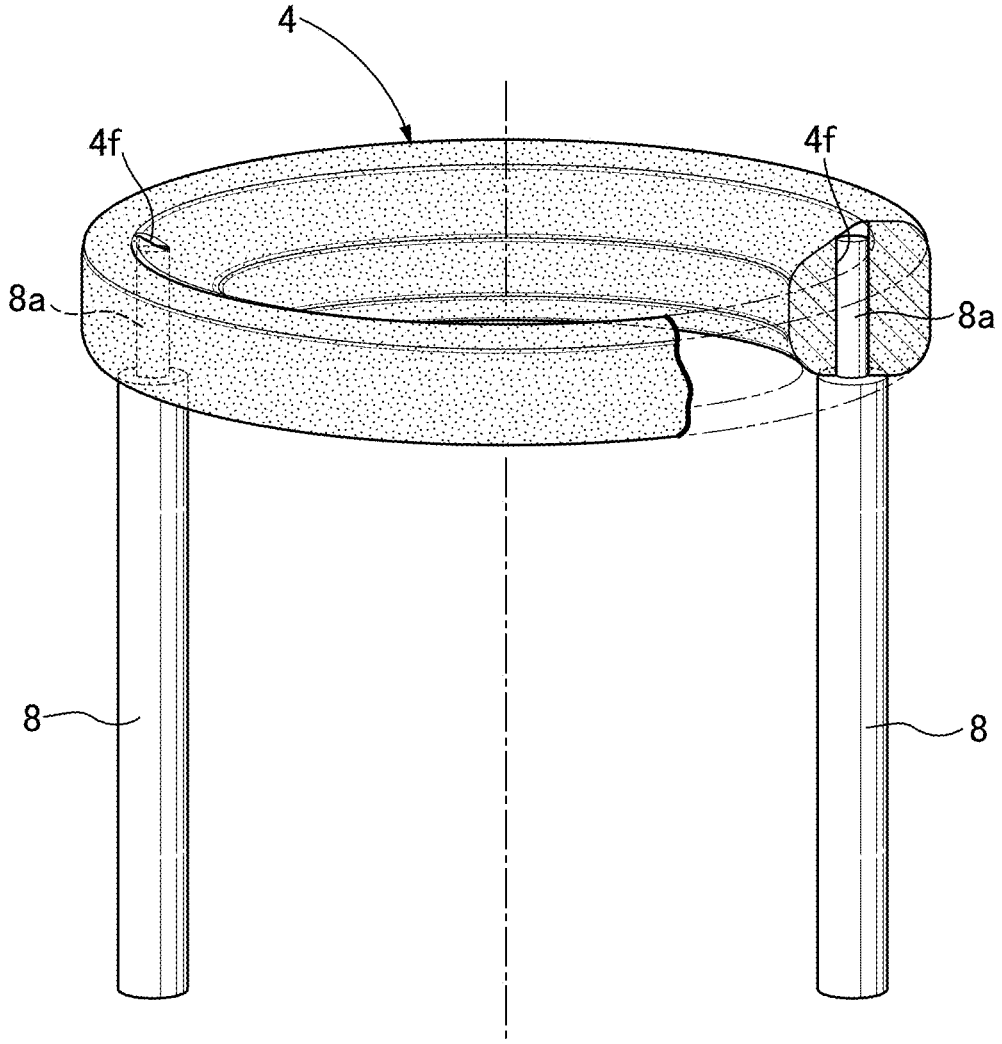
FIG. 3 shows the breathable salt core and a support pin thereof, which are to be set in the production device of FIG. 2 (A). (first embodiment)

Each support rod 8 is formed into a long and thin columnar shape as shown in FIG. 2 (A) and FIG. 3, has a small-diameter support pin 8*a* in its upper end part, and supports the salt core 4 via its upper end part. The support pin 8*a* extends within a support hole 4*f*, which is formed in the salt core 4 and is described later, from the lower end to the vicinity of the upper end of the salt core 4.

The salt core 4 is as shown in FIG. 3 formed into an annular shape with powder molded salt particles 17 in an uncalcined state using a molding machine 11, which is described later. The cross section of the salt core 4 is as shown in FIGS. 2 (B), (C) formed laterally asymmetrically from an outside face 4*a* on the outermost side in the radial direction and parallel to the central axis L, a lower face 4*b* extending radially inward from the lower end of the outside face 4*a*, an inside face 4*c* extending upward from the inner end of the lower face 4*b* so as to be parallel to the central axis L with a length that is shorter than the length of the outside face 4*a*, an inclined face 4*d* extending obliquely upward and radially outward from the upper end of the inside face 4*c*, and an upper face 4*e* extending radially outward from the extremity of the inclined face 4*d* up to the upper end of the outside face 4*a*, part where the respective faces are connected being formed into a smooth arc shape. A pair of the support holes 4*f* are formed at substantially opposite positions on the diameter of the salt core 4 so as to extend vertically, the support pin 8*a* of the respective support rods 8 is inserted from below through the support hole 4*f*, and parts other than the support holes 4*f* of the salt core 4 are formed into a solid so as to form a gap 18 for retaining residual gas 10 within the cavity 2 pushed out by the molten metal in the casting process, which is described later, between the salt particles 17.

A method of casting the piston P having the cooling channel C, using the manufacturing method of the present invention, is explained by reference to FIG. 2 (A).

In order to form the piston P by casting, the mold 1 is opened, and the support pin 8*a* of the support rod 8, which has been inserted into and retained by the through hole 9 of the large-diameter cylindrical portion 3*a*, is inserted into the support hole 4*f* of the salt core 4, thus supporting the salt core 4 within the cavity 2. In this state, a gap through which a molten metal can flow is formed between an outer face of the salt core 4 and an inner wall face of the cavity 2 except in places where the support rods 8 protrude (as described later, the places where the support rods 8 protrude become the openings H1, H2 in the piston P subsequent to casting).

In this state, the mold 1 is closed, the molten metal 5 is poured into the cavity 2 via the pouring inlet 6, the molten metal 5 moves upward along an outer peripheral face of the metal core 3 within the cavity 2, and when it reaches the upper end of the large-diameter cylindrical portion 3*a* of the metal core 3 the flow branches into a flow that moves upward on the outer peripheral side along the outside face 4*a* of the salt core 4 and a flow that moves upward on an inner peripheral side along the inside face 4*c* from the lower face 4*b* of the salt core 4.

Figure 4:
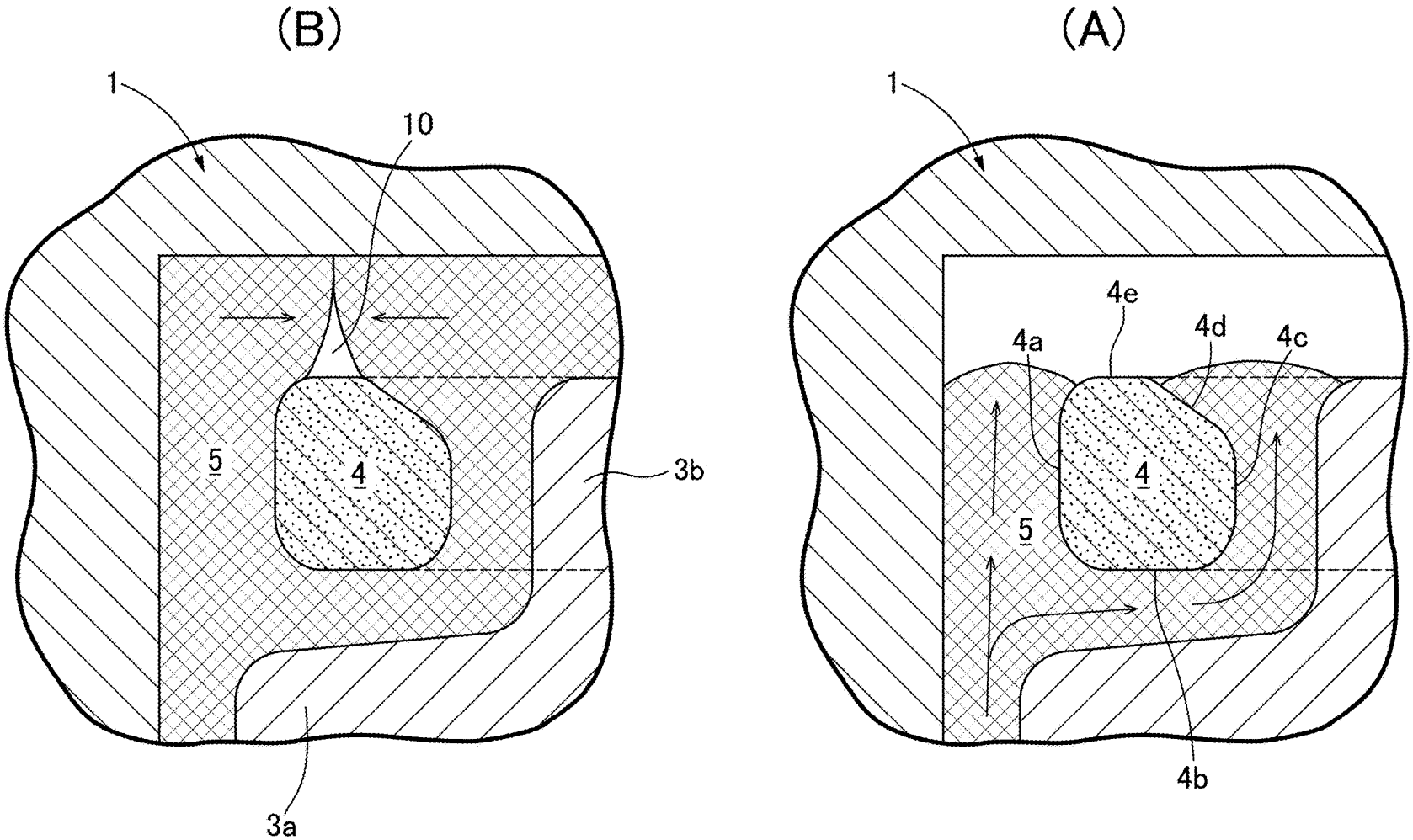
FIG. 4 is a diagram for explaining the flow of molten metal when the molten metal is poured into the cavity of the mold of FIG. 2 (A). (first embodiment)
Figure 6:
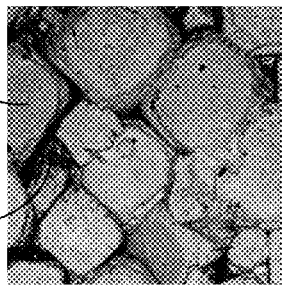
FIG. 6 is a scanning electron microscope image of the surface of the salt core when the molding pressure is at two different levels when molding using the molding machine of FIG. 5 (A). (first embodiment)
Figure 6:
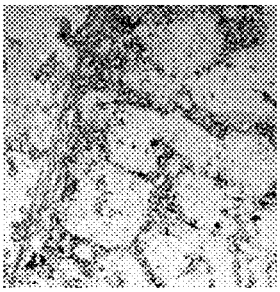

FIG. 4 (A) shows a state in which the molten metal 5 thus branched has reached an upper face of the salt core 4. When from this state the molten metal 5 moves further upward within the cavity 2, at a position where the molten metal that has moved around to the upper part from the inner peripheral side of the salt core 4 and the molten metal that has moved around to the upper part from the outer peripheral side of the salt core are combined, as shown in FIG. 4 (B), the residual gas 10 within the cavity that have been pushed out by the molten metal moving around from the inner peripheral side and the outer peripheral side collide in a part where they meet, and this inhibits the flow of the molten metal 5 thus causing a possibility of incomplete filling. However, according to the manufacturing method of the present invention, as shown in FIG. 6, which is described later, since the gap 18, which is capable of retaining the residual gas 10 within the cavity 2 pushed out by molten metal, is formed between the salt particles 17 of the breathable salt core 4 so as to make the residual gas 10 enter the gap 18 via a surface of the salt core 4 and be retained, it is possible to prevent the flow of molten metal 5 from being inhibited in the residual gas 10 of the opposing part and incomplete filling from occurring.

After the rough material of the piston P is thus molded by charging the interior of the cavity 2 with the molten metal 5, the support rods 8 are made to descend and pulled out from the piston P, the mold 1 is opened and the piston P is taken out, and high pressure water is applied to the salt core 4 remaining within the cooling channel C via the openings H1, H2 of the piston P formed by pulling out the support rods 8, thus dissolving and removing the starting salt of the salt core 4.

A method for manufacturing the breathable salt core 4 of the present invention, which can form the gap 18 capable of retaining gas remaining in the cavity, between the salt particles 17 of the salt core 4 is now explained below.

Figure 5:
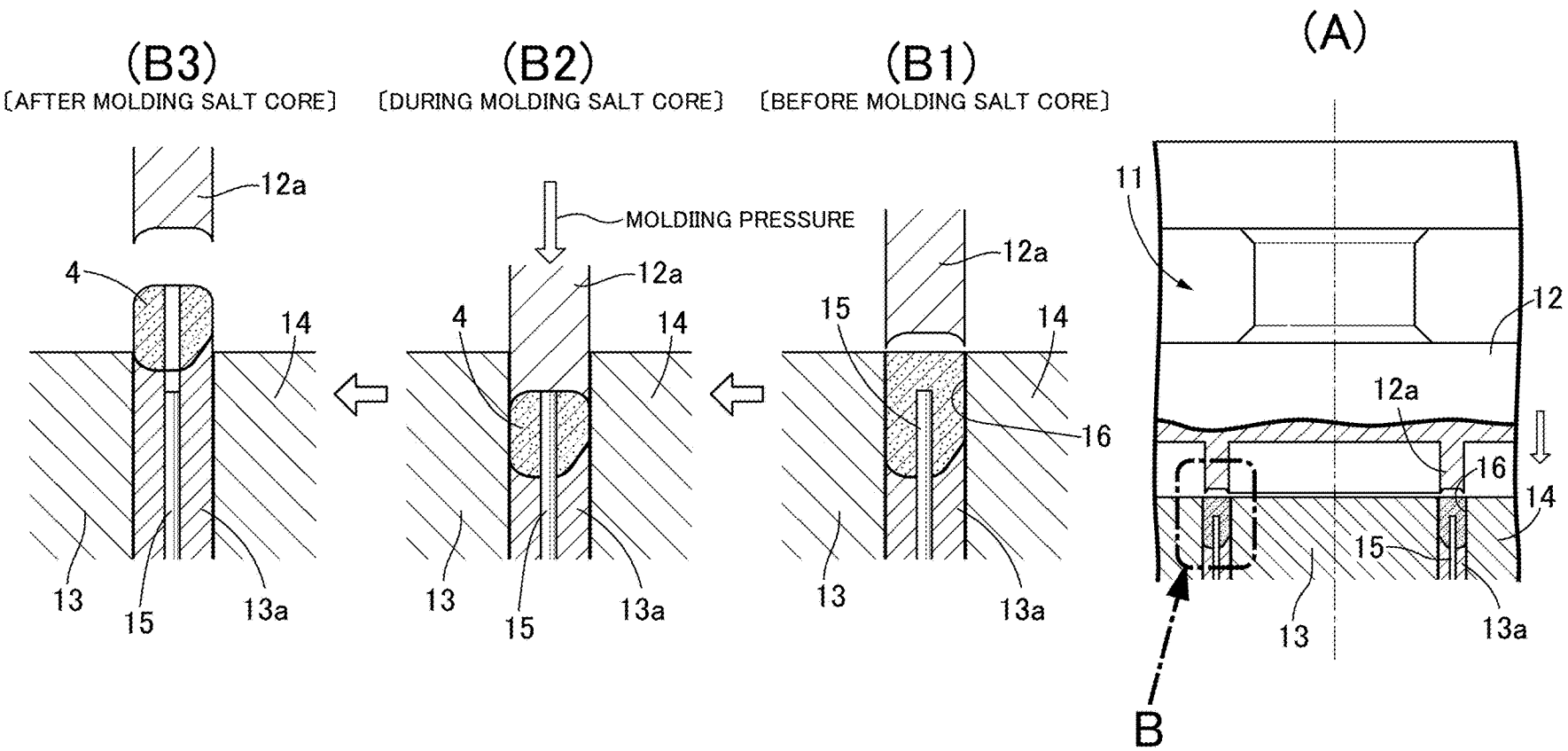
FIG. 5 (A) shows the structure of a molding machine for subjecting the breathable salt core of the present invention to powder compression and molding, and the structure of a mold of the molding machine, and FIGS. 5 (B1) to (B3) are enlarged views of part B of FIG. 5 (A) showing stepwise the operation when molding the salt core. (first embodiment)

FIG. 5 (A) shows the molding machine 11 for powder compressing and molding the breathable salt core 4 used in the present invention; the molding machine 11 has an upper punch 12 having an annularly formed pressing portion 12*a*, a lower punch 13 similarly having an annularly formed pressing portion 13*a*, and a die 14 surrounding the pressing portion 13*a* of the lower punch 13, a pair of rod-shaped bodies 15 protruding from the pressing portion 13*a* of the lower punch 13 in order to form the support hole 4*f* of the salt core 4, which is described above. The pressing portion 12*a* of the upper punch 12, the pressing portion 13*a* of the lower punch 13, the die 14, and the rod-shaped body 15 form molds of the molding machine 11 for powder compressing and molding the breathable salt core 4.

As shown in FIG. 5 (B1), opposing faces of the pressing portion 12*a* of the upper punch 12 and the pressing portion 13*a* of the lower punch 13 have a shape that coincides with the shape of the salt core 4 subsequent to molding so that the salt core 4 does not have to be subjected to machining processing after powder molding. When molding the salt core 4, starting salt having a substantially uniform particle size with an average of on the order of 350 μm is first charged into a groove part 16 sandwiched between the die 14 and a side wall of the lower punch 13 on the upper face of the pressing portion 13*a* of the lower punch 13, as shown in FIG. 5 (B2) the upper punch 12 is made to descend, and the starting salt charged into the groove part 16 is compressed with a low molding pressure of 80 to 130 MPa by means of the pressing portion 12*a*, thus carrying out powder molding of the salt core 4. After powder molding, as shown in FIG. 5 (B3) the pressing portion 12*a* of the upper punch 12 is moved upward and the pressing portion 13*a* of the lower punch 13 is made to ascend, thus enabling the powder molded breathable salt core 4 to be pulled upward from the interior of the groove 16 while drawing out the rod-shaped body 15.

Since the breathable salt core 4 used in the present invention is formed so that the starting salt is compressed with such a low pressure of 80 to 130 MPa, an excessive load will not be applied to the opposing faces of the pressing portions 12*a*, 13*a* of the upper and lower punches, which are the molds of the molding machine 11, and it is therefore possible to prevent the pressing portions 12*a*, 13*a* of the upper and lower punches from being broken early even when the opposing faces of the pressing portions 12*a*, 13*a* of the upper and lower punches have in advance a shape that coincides with the shape of the salt core 4 subsequent to powder molding.

Moreover, as described above, since the cross-sectional shape of the salt core 4 can be molded as it is by means of the upper and lower punches 12, 13 with a low molding pressure, the molding precision is good, and it is unnecessary to subject it to machining processing after powder molding; after powder molding, merely by taking out the powder molded salt core 4, while drawing out the rod-shaped body 15, from the groove part 16 sandwiched between the die 14 and the pressing portion 13*a* of the lower punch 13, the breathable salt core 4 having the support hole 4*f* can be produced without carrying out a calcination step or a machining processing step, and so-called net shaping is thus possible.

The capability of fully ensuring the gap 18, which can retain gas, between starting salt particles by compressing the starting salt of the breathable salt core 4 with a low pressure of 80 to 130 MPa, and the capability of maintaining a strength that can prevent setting cracks when it is set within the cavity 2 of the mold 1 is now explained below.

FIG. 6 shows an electron microscope photograph of the surface of a breathable salt core of the present embodiment when the molding pressure is 90 MPa and an electron microscope photograph of the surface of a conventional salt core when the molding pressure is 210 MPa; in the electron microscope photograph of the present embodiment, reference numeral 17 shows salt particles, and reference numeral 18 shows the gap. As is clear from this electron microscope photograph, in the present embodiment the gap 18 is an electron microscopic gap capable of retaining gas remains between the salt particles 17, but in the conventional arrangement in which molding is carried out with a molding pressure of 210 MPa, which is a conventionally usual molding pressure, it can be seen that a gap 18 capable of retaining gas does not exist.

Figure 7:
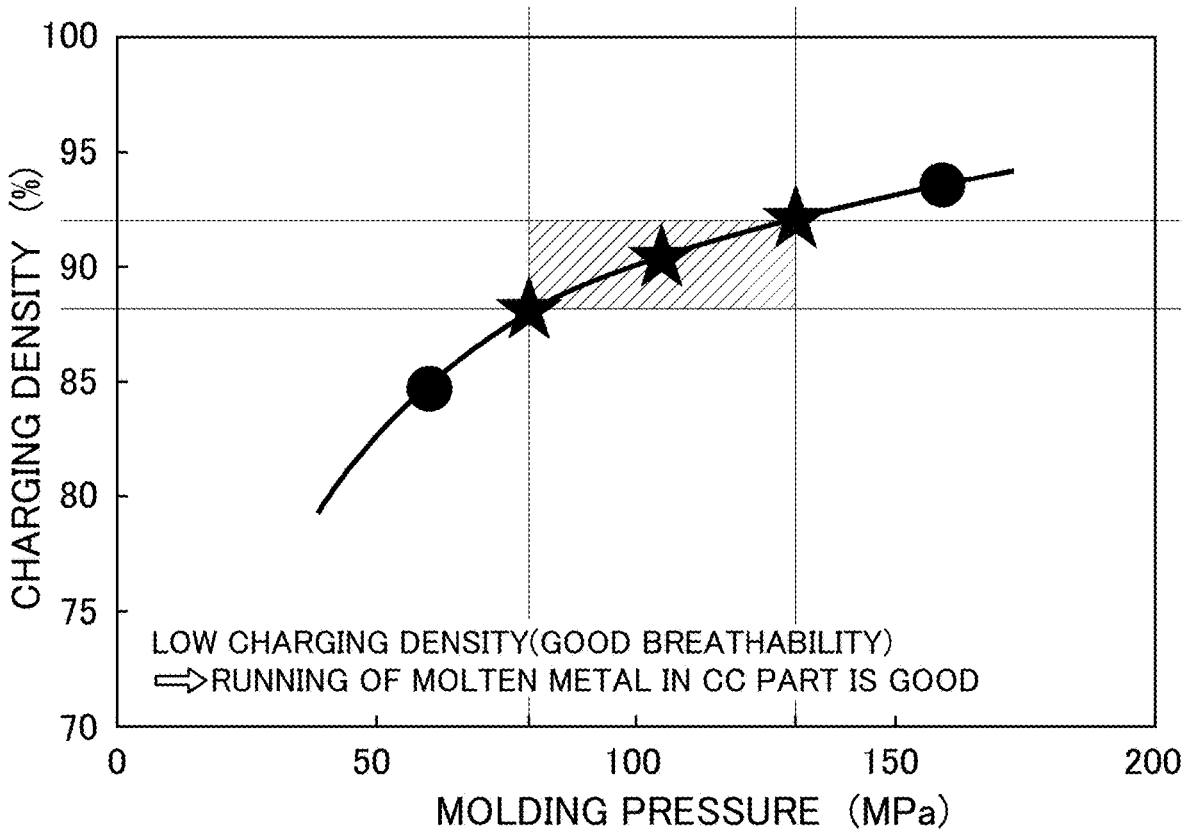
FIG. 7 is a diagram showing the relationship between molding pressure and charging density of the salt core. (first embodiment)

Moreover, as is clear from FIG. 7, in which the abscissa is molding pressure (MPa) and the ordinate is charging density (%) and which shows the relationship between the molding pressure and the charging density, the breathable salt core 4, which is produced with a molding pressure of 80 to 130 MPa, is able to have a charging density that is contained within a range of 88% to 92% as shown by ★, in the casting process the gap 18, which is capable of retaining the gas 10 remaining in the cavity 2, can be formed between the salt particles 17, running properties of molten metal during casting are good, and it is possible to maintain a strength that can prevent setting cracks from occurring when the salt core 4 is set within the cavity 2 of the mold 1.

This point is further explained by reference to FIG. 8.

Figure 8:
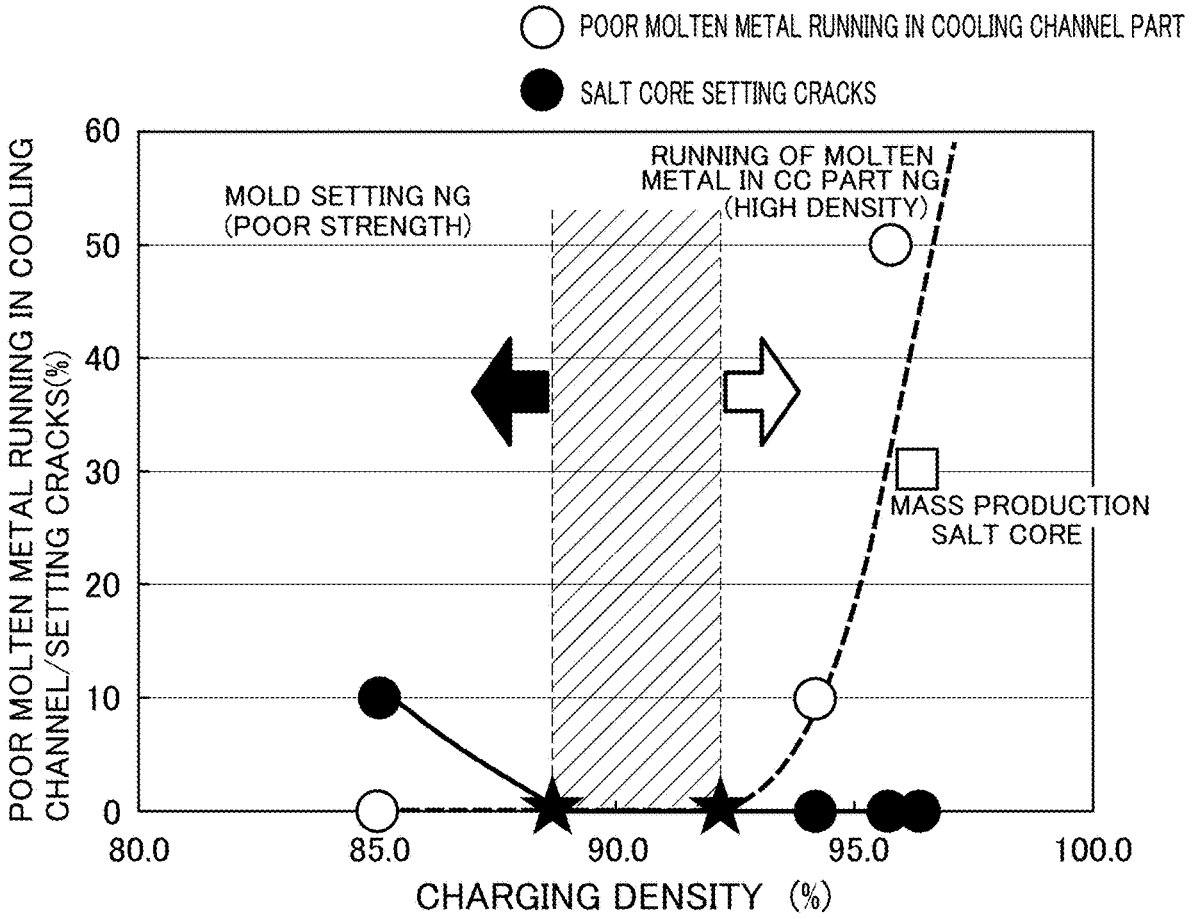
FIG. 8 is a diagram showing the relationship between charging density of the salt core and percentage misruns in the cooling channel and the relationship between charging density and percentage setting cracks. (first embodiment)

FIG. 8 is a graph in which the abscissa is charging density and the ordinate is percentage misruns within the cooling channel C and percentage setting cracks, showing the relationship between the charging density and the percentage misruns by a chain line and the relationship between the charging density and the percentage setting cracks by a solid line; as is clear from this graph, the percentage misruns within the cooling channel C shown by ○ is 0% until the charging density exceeds 92% and gradually increases from the point after the charging density exceeds 92%, and the percentage occurrence of setting cracks shown by • is 0% when the charging density is 88% or greater but gradually increases as the charging density decreases when the charging density is less than 88% (★ shows an area where ○ and • overlap one another). It can therefore be seen that when the charging density is contained in a range of 88% to 92%, as shown by ★ it is possible to suppress the percentage misruns and the percentage setting cracks to 0%, it is possible by compressing the starting salt with a low pressure of 80 to 130 MPa to fully ensure the gap 18, which is capable of retaining gas between starting salt particles, and it is also possible to retain a strength that can prevent setting cracks from occurring when it is set within the cavity 2 of the mold 1.

On the other hand, in the conventional method for manufacturing the cast product using salt core, it is subjected to machining processing for molding it into a predetermined shape before being set in the salt core in a cavity of a casting mold; in order to ensure a strength that can withstand machining processing, starting salt particles having different particle sizes are usually blended in order to improve the charging density, an additive such as a binder such as water glass or a lubricant such as a metallic soap is added to the starting salt thus blended to thus further increase the strength, furthermore, powder molding is carried out by pressing with a high pressure to thus increase the charging density, and calcination is carried out in order to further enhance the strength. Since the salt core is subjected, subsequent to such steps, to machining processing for molding the salt core into a predetermined shape or hole machining for forming a support pin support hole, the production process becomes complicated and it is difficult to form the salt core at low cost. In the salt core produced by the conventional steps in such a way, the charging density of the starting salt is high, it is difficult for residual gas within the cavity to enter the interior of the salt core, and incomplete filling of molten metal easily occurs. However, since in the method for manufacturing the cast product using the breathable salt core 4 of the present invention, the gap 18 is formed, which is capable of retaining gas, between the innumerable powder molded salt particles 17, due to powder molding being carried out with a low pressure, it is possible to directly powder mold the salt particles 17, which have a substantially uniform particle size and do not contain an additive, with a low pressure, and not only is it possible to omit operations of calcination or machining processing, but it is also possible to eliminate the necessity for blending salt particles 17 having different particle sizes or adding an additive such as a binder such as water glass or a lubricant such as a metallic soap, thus enabling the breathable salt core, which is resistant to incomplete filling of molten metal, to be produced simply and at low cost.

The operation of the embodiment of the present invention having the above arrangement is now explained.

In the present embodiment, in a method for manufacturing the piston P using the salt core, which is placed in the cavity 2 of the mold 1 and is dissolved and removed after casting in order to mold the cooling channel C of the piston P, the breathable salt core 4 in which the innumerable salt particles 17 is formed by powder molding into a predetermined shape corresponding to the cooling channel C of the piston P, and the gap 18, that is capable of retaining the residual gas 10 remaining in the cavity in the casting process, is formed between the innumerable salt particles 17, is placed within the cavity 2 of the casting mold 1 in the uncalcined state, and in the subsequent casting process, the residual gas 10 within the cavity 2, which is pushed out by molten metal, is made to enter the gap 18 via the surface of the breathable salt core 4 and be retained within the breathable salt core 4, and therefore, it is possible by allowing the gas 10 remaining in the cavity 2 in the casting process to enter the gap 18 and be retained thereby, to prevent the flow of molten metal 5 from being inhibited by the residual gas 10, thus forming the cast product having good running properties so that hardly any incomplete filling of the molten metal 5 occurs.

Moreover, since it is not necessary to specially provide the breathable salt core 4 with a groove via which the residual gas 10 within the cavity 2 pushed out by the molten metal 5 can escape, the production process is simple, and it can be formed at low cost.

Furthermore, since the breathable salt core 4 has a charging density of 88% to 92%, it is possible to fully ensure the gap 18, which retains the gas 10 remaining in the cavity in the casting process, to thus achieve good running properties and it is also possible to maintain a strength that can prevent setting cracks from occurring when it is set within the cavity 2.

Moreover, the piston P equipped with the cooling channel C having good running properties can easily be produced at low cost.

Furthermore, since the breathable salt core 4 is used without being calcined, it is possible to prevent contact parts between the salt particles 17 from being melted accompanying calcination, thus enabling the gap 18, which is capable of retaining gas remaining in the cavity, to be reliably formed between the salt particles 17.

Moreover, the breathable salt core is powder molded from the salt particles 17 with a molding pressure of 80 to 130 MPa so as to give a charging density of 88% to 92%, and after powder molding it is produced without carrying out a calcination step or a machining processing step. Due to the powder molding being carried out with a low pressure of 80 to 130 MPa, the mold of the molding machine 11, which coincides with the cross-sectional shape of the salt core, can be used to thus enable a machining processing step to be omitted, and due to the charging density being set at 88% to 92% at that time, it is possible to prevent setting cracks from occurring when the salt core 4 is set within the cavity 2 as it is, thus enabling a calcination step to be omitted, and the production process is thereby simple and the cost is low.

Furthermore, due to the powder molding being carried out with a low pressure, the gap 18, which is capable of retaining the gas 10 remaining in the cavity 2 in the casting process, is formed between the innumerable salt particles 17 subsequent to molding, and it is therefore possible, by using the breathable salt core 4, to make the gas 10 remaining in the cavity 2 in the casting process enter the gap 18 and prevent the flow of molten metal from being impaired, thus enabling the cast product having good running properties to be formed.

Moreover, in the breathable salt core 4, since the salt particles 17 having a substantially uniform particle size and containing no additive such as water glass or a metallic soap are directly powder molded with a low pressure on their own, it is possible to use for producing the cast product a breathable salt core that forms simply and inexpensively the gap 18 which is capable of retaining gas between the salt particles 17 without blending the salt particles 17 having different particle sizes and without adding an additive such as a binder such as water glass or a lubricant such as a metallic soap.

An embodiment of the present invention is explained above, but the present invention may be modified in a variety of ways as long as the modifications do not depart from the subject matter.

For example, the method for manufacturing the cast product using the breathable salt core 4 of the present invention can also be used effectively for molding a cast product having a hollow part other than one forming the piston P having the cooling channel C.

The invention claimed is:

1. A method for manufacturing a cast product having a hollow part using a breathable salt core, comprising the steps of:

forming the breathable salt core with powder by molding innumerable salt particles into a predetermined shape corresponding to the hollow part in which the breathable salt core has no groove for escaping residual gasses and in which the breathable salt core has an electromicroscopic gap formed between the innumerable salt particles;

placing the breathable salt core within a cavity of a gravity casting mold in an uncalcined state;

gravity casting the cast product by flowing molten metal into the cavity thereby producing the residual gas at where branched flow of the molten material meets each other;

making the residual gas enter into the electromicroscopic gap via a surface of the breathable salt core so as to retain the residual gas within the breathable salt core; and dissolving and removing the salt core.

2. The method for manufacturing the cast product using the breathable salt core according to claim 1, wherein the cast product is a piston for an internal combustion engine, and the hollow part is a cooling channel in a crown of the piston.

3. The method for manufacturing the cast product using the breathable salt core according to claim 1, wherein in the breathable salt core the salt particles are powder molded at a molding pressure of 80 to 130 MPa so as to give a charging density of 88% to 92%, and a machining processing step subsequent to said powder molding is omitted.

4. The method for manufacturing the cast product using the breathable salt core according to claim 3, wherein the salt particles, which do not contain an additive, are directly powder molded on their own.

5. A method for manufacturing a cast product having a hollow part using a breathable salt core, comprising the steps of:

forming the breathable salt core with powder by molding innumerable salt particles into a predetermined shape corresponding to the hollow part in which the breathable salt core has no groove for escaping residual gasses and so that the breathable salt core has a charging density subsequent to powder molding of 88% to 92% and in which the breathable salt core has an electromicroscopic gap is formed between the innumerable salt particles;

placing the breathable salt core within a cavity of a gravity casting mold in an uncalcined state;

gravity casting the cast product by flowing molten metal into the cavity thereby producing the residual gas at where branched flow of the molten material meets each other;

making the residual gas enter into the electromicroscopic gap via a surface of the breathable salt core so as to retain the residual gas within the breathable salt core; and dissolving and removing the salt core.

6. The method for manufacturing the cast product using the breathable salt core according to claim 5, wherein in the breathable salt core the salt particles are powder molded at a molding pressure of 80 to 130 MPa so as to give the charging density of 88% to 92%, and a machining processing step subsequent to said powder molding is omitted.

7. The method for manufacturing the cast product using the breathable salt core according to claim 6, wherein the salt particles, which do not contain an additive, are directly powder molded on their own.

8. The method for manufacturing the cast product using the breathable salt core according to claim 5, wherein the cast product is a piston for an internal combustion engine, and the hollow part is a cooling channel in a crown of the piston.

* * * * *